US006170679B1

(12) United States Patent
Frye et al.

(10) Patent No.: US 6,170,679 B1
(45) Date of Patent: Jan. 9, 2001

(54) DISPLAY HANGER

(75) Inventors: Betty F. Frye, Claremont; Dwight L. Reese, Hickory, both of NC (US)

(73) Assignee: Conover Plastics, Inc., Conover, NC (US)

( * ) Notice: Under 35 U.S.C. 154(b), the term of this patent shall be extended for 0 days.

(21) Appl. No.: 09/413,176

(22) Filed: Oct. 7, 1999

(51) Int. Cl.[7] ..... A47F 7/00

(52) U.S. Cl. ..... 211/113; 211/85.3; 223/85; 223/87; 223/95

(58) Field of Search ..... 211/113, 119, 211/116, 85.3; 223/95, 97, 88, 85

(56) References Cited

U.S. PATENT DOCUMENTS

D. 91,319 * 1/1934 Falk .
2,058,217 * 10/1936 Dixon ..... 211/119
2,191,714 * 2/1940 Gustin ..... 211/119
2,192,167 * 3/1940 Bagley et al. ..... 211/113
2,451,552 * 10/1948 Hayward ..... 223/95
2,498,400 * 2/1950 Du Lude ..... 223/88
2,594,966 * 4/1952 McKinney ..... 223/88
2,598,315 * 5/1952 Sweet ..... 211/119
2,822,967 * 2/1958 Spitz ..... 223/88
3,651,999 * 3/1972 Fiocca ..... 223/88
3,945,500 * 3/1976 Meckstroth ..... 211/113
4,366,909 * 1/1983 Fahmi ..... 211/116
6,006,964 * 12/1999 White ..... 223/85

OTHER PUBLICATIONS

Conover Plastics, Inc. brochure (undated 2 pages).

* cited by examiner

*Primary Examiner*—Robert W. Gibson, Jr.

(57) ABSTRACT

A display hanger is provided which allows multiple pairs of socks or other articles to be hung without interference from other pairs on arms therebelow. The display hanger can be manufactured using conventional molding techniques employing standard polymeric materials. The arms are offset to allow better viewing and convenience of the supported articles while loading and unloading the hangers.

14 Claims, 4 Drawing Sheets

DISPLAY HANGER

FIELD OF THE INVENTION

The invention herein pertains to a hanger for displaying socks or other similar articles and specifically pertains to a hanger having multiple arms which are offset from one another as they descend whereby the articles freely hang without straddling or bowing behind the article next below.

DESCRIPTION OF THE PRIOR ART AND OBJECTIVES OF THE INVENTION

Retail merchandising in recent years has required that socks, underwear, handkerchiefs and similar articles be conveniently displayed so that consumers can examine and easily view, compare and select the merchandise they desire. Hosiery such as stockings, pantyhose, socks and the like are often openly presented on small plastic hangers which contain multiple article pairs. Certain of the standard plastic hangers in use today allow for two or more pairs to be displayed in vertical fashion with the upper pair partially bowed and displaced by the pair directly below. Such display hangers provide for an efficient use of the display space but the appearance is bulky and unappealing to the consumers. Thus, if a sock display hanger has multiple arms for a plurality of sock pairs, the upper arms present a partial view of the socks whereas the sock on the lowermost arm can be fully viewed. As additional pairs are added the bow and displacement becomes more exaggerated.

Thus, with the problems and disadvantages of conventional display hangers for multiple articles, the present invention was conceived and one of its objectives is to provide a display hanger which is easy to load with multiple articles for display.

It is still another objective of the present invention to provide an inexpensive, molded plastic display hanger which allows multiple articles to hang freely without interference from the article below.

It is yet another objective of the present invention to provide a display hanger which includes multiple arms for supporting articles such as socks with each succeeding arm being horizontally offset from the arm above. The end result is a more appealing package for the consumers.

It is still another objective of the present invention to provide a method of displaying articles in which each article freely hangs without being displaced behind another for ease in packaging by the manufacturers.

Various other objectives and advantages of the present invention will become apparent to those skilled in the art as a more detailed description is set forth below.

SUMMARY OF THE INVENTION

The aforesaid and other objectives are realized by providing a hanger for displaying multiple articles such as sock pairs in a manner for better handling in manufacturing and viewing by the consumers. The display hanger includes a hook, a neck, a first support arm and a second support arm whereby the second support arm is horizontally offset from the first support arm to allow socks or other articles being displayed to be freely hung without interference from the article next below. The display hanger may have a variety of designs or configurations yet each has a plurality of arms arranged in a descending offset or "stair-step" fashion. A connector attaches each succeeding arm to the one immediately above and may have a "L" or other shape for the necessary offset. The display hanger herein is integrally molded from a suitable polymeric material such as polyethylene, polyvinyl chloride, polycarbonate, polystyrene or other standard plastic or other suitable materials.

DETAILED DESCRIPTION OF THE PREFERRED EMBODIMENT AND OPERATION OF THE INVENTION

Figure 1:
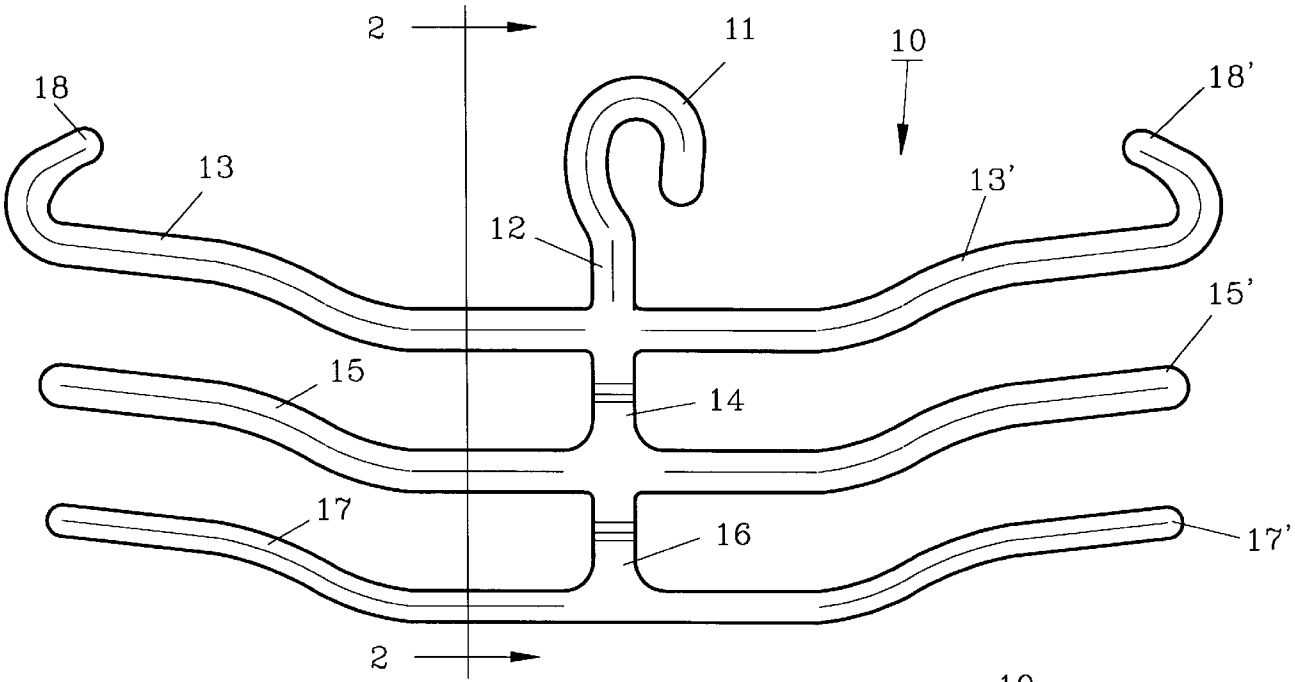
FIG. 1 shown front elevational view of a six pair display hanger.
Figure 6:
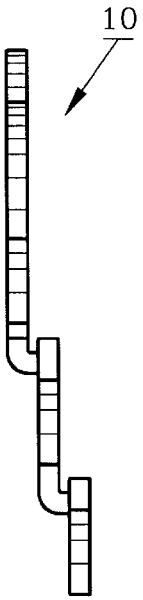
FIG. 6 pictures a left side elevational view of the display hanger as shown in FIG. 1 along lines 2—2, the right side being a mirror image thereof.
Figure 2:
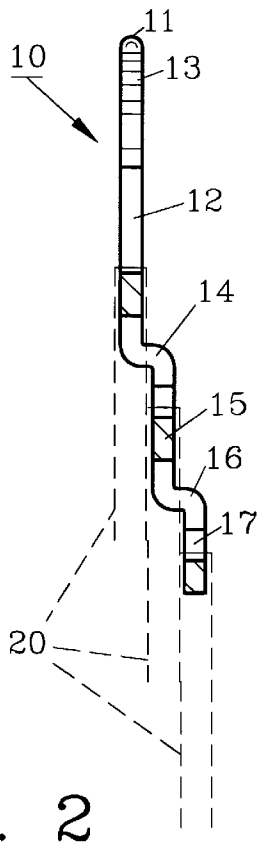
FIG. 2 illustrates a cross-sectional view along lines 2—2 as shown in FIG. 1.
Figure 3:
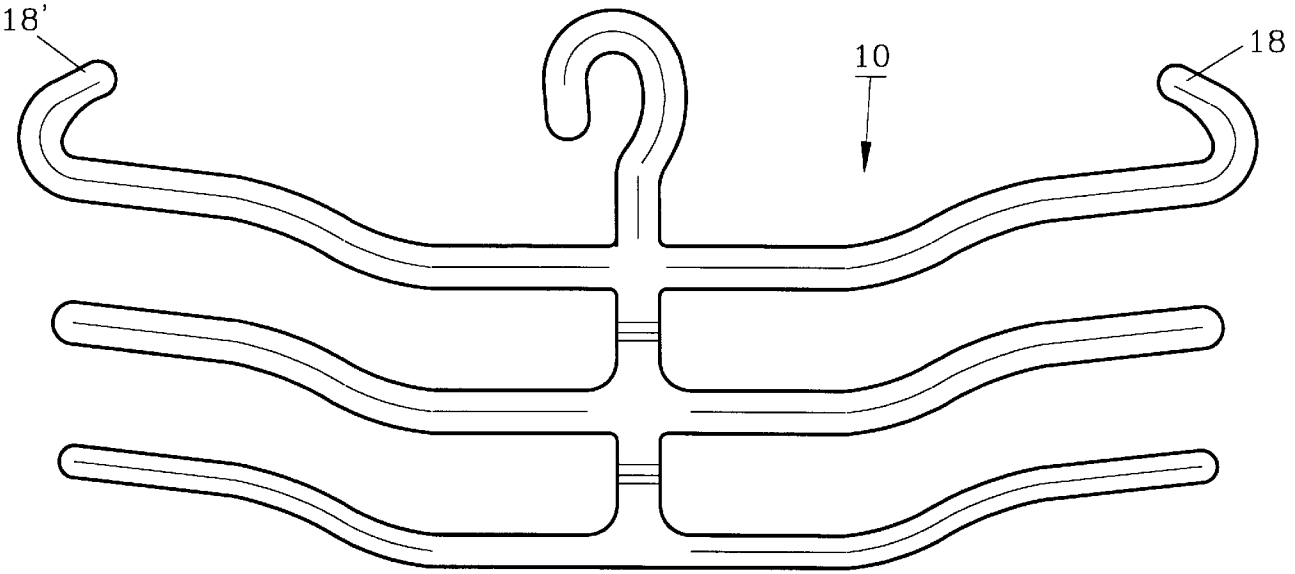
FIG. 3 depicts a rear elevational view of the embodiment shown in FIG. 1.

For a better understanding of the invention and its operation, turning now to the drawings, FIG. 1 show a front view of the preferred embodiment of invention whereby display hanger 10 includes hook 11 joined to neck 12. Neck 12 is attached to first arm pair 13, 13' in a plane for supporting and displaying for example two pairs of men's socks. Connector 14 is affixed to arm pair 13, 13' and is also joined to second arm pair 15, 15'. Second arm pair 15, 15' is horizontally offset from first arm pair 13, 13' as shown in FIGS. 2 and 6. Third arm pair 17, 17' is joined to connector 16 which is attached at its upper end to second arm pair 15, 15'. The preferred method of manufacturing display hanger 10 utilizes conventional polymeric materials such as polystyrene through conventional molding techniques. As seen, arm pairs 15, 15' are horizontally offset from first arm pairs 13, 13' by connector 14 whereby in the method of use, articles such as sock pairs are placed on arms 13, 13' and hang freely and do not interfere or bow behind succeeding articles on arms 15, 15' or 17, 17' for ease in loading and convenience in viewing. Upward projecting tips 18, 18' as located at the terminal ends of arms 13, 13' respectively as seen in FIGS. 1 and 3 and are somewhat C-shaped to stabilize socks placed thereon.

Figure 4:
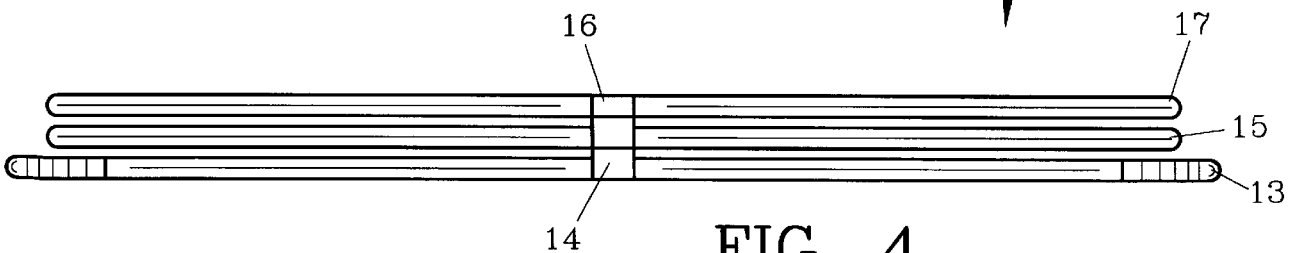
FIG. 4 features a bottom plan view of the hanger as shown in FIG. 1.
Figure 5:
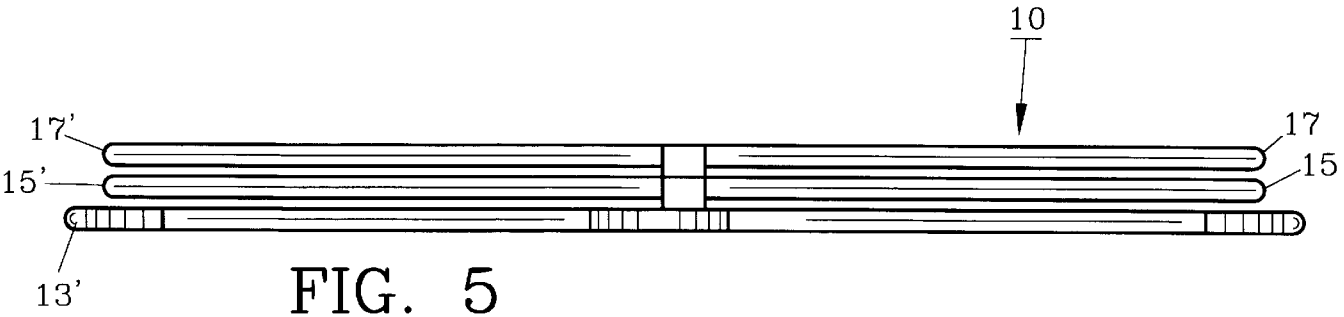
FIG. 5 demonstrates a top plan view of the display hanger as shown in FIG. 1.
Figure 9:
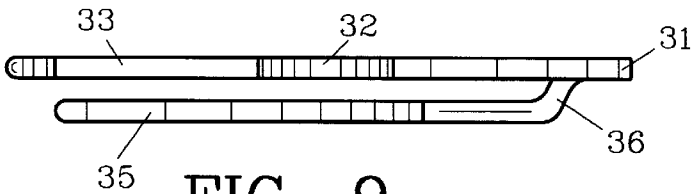
FIG. 9 depicts a top plan view of the embodiment as shown in FIG. 7.

For a clearer view of the offset, FIG. 2 demonstrates in cross-sectional representation the view of the display hanger with fabric articles 20 shown in ghost fashion on arms 13, 15 and 17. FIG. 3 shows a rear view of the preferred embodiment of display hanger 10, whereas FIGS. 4 and 5 also illustrate the horizontal offset of arms 13, 13', 15, 15' and 17, 17'.

Figure 7:
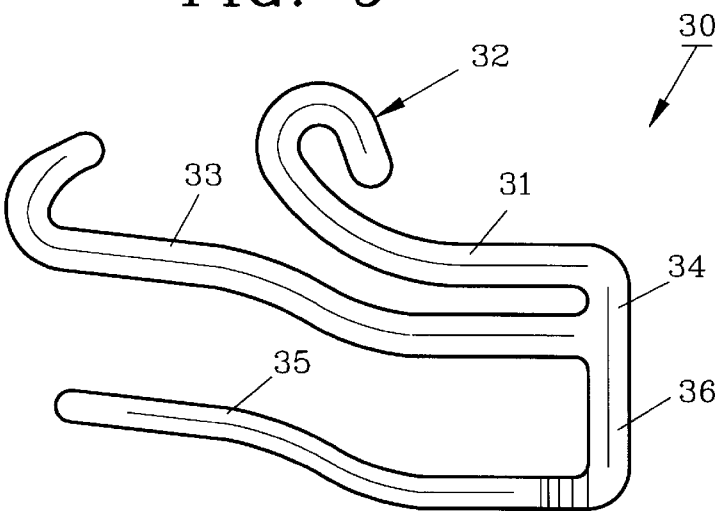
FIG. 7 shows a front view of a second embodiment of the invention.
Figure 10:
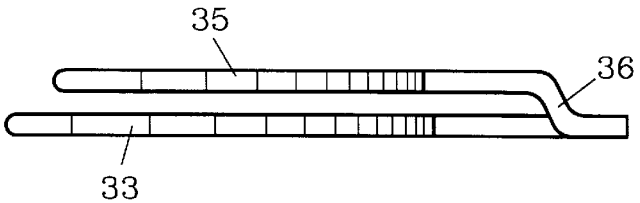
FIG. 10 features a bottom elevational view of the embodiment as shown in FIG. 7.
Figure 11:
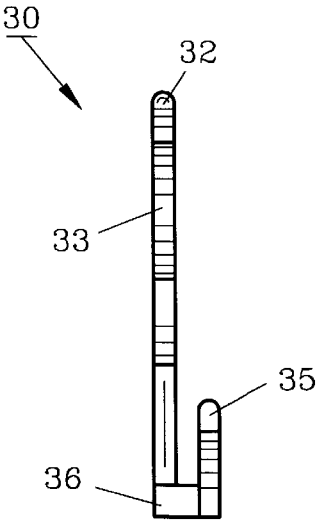
FIG. 11 demonstrates a left side elevational view of the embodiment as shown in FIG. 7.
Figure 8:
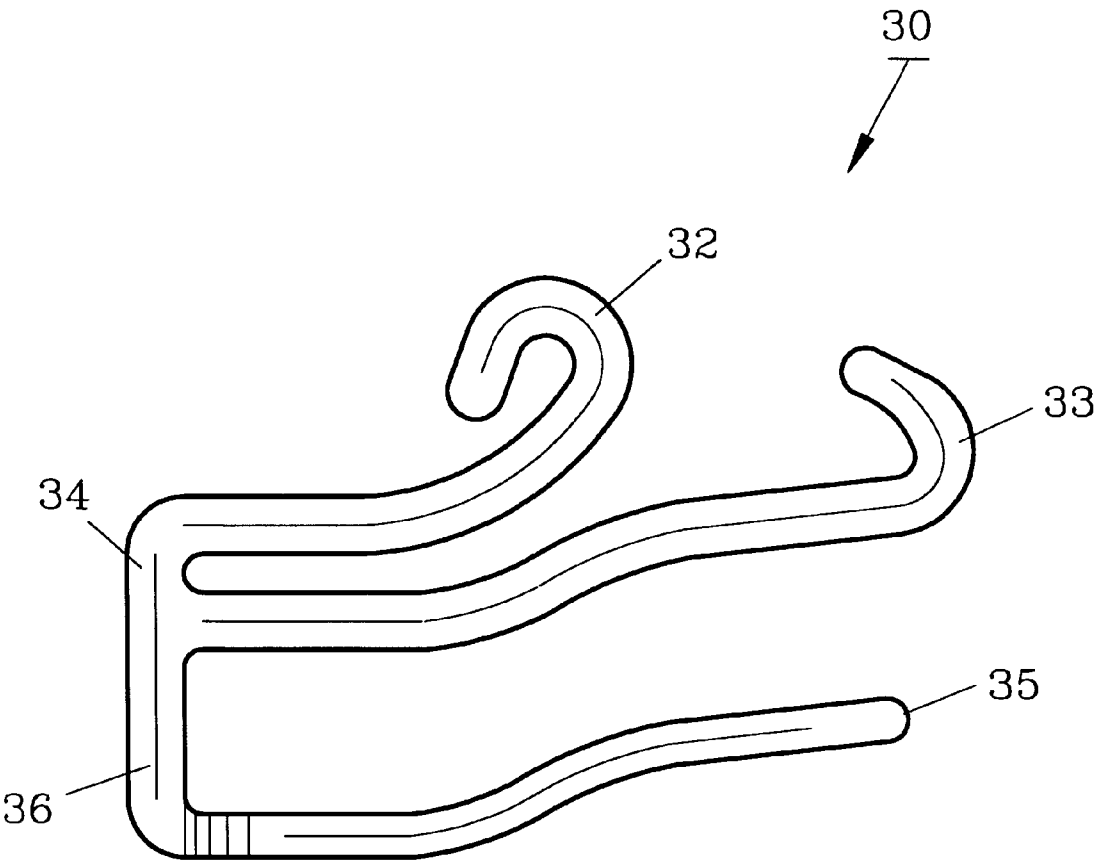
FIG. 8 illustrates a rear elevational view of the embodiment as shown in FIG. 7.
Figure 12:
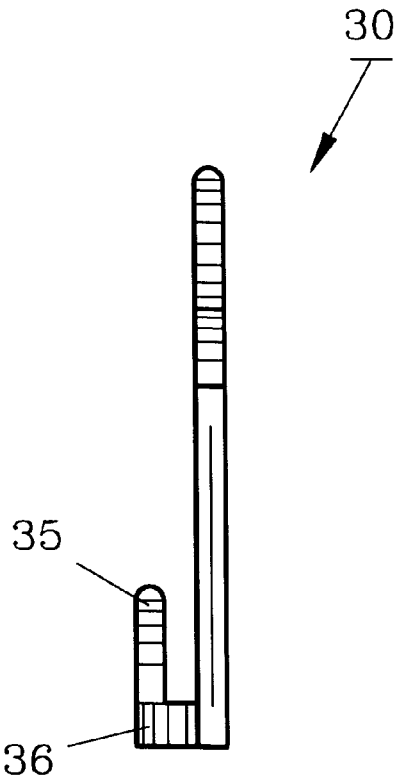
FIG. 12 pictures a right side elevational view of the embodiment as shown in FIG. 7.

In FIG. 7 a "half" display hanger 30 is shown having a neck 31 with an attached hook 32. First arm 33 is joined to neck 31 by connector 34. Below first arm 33 and offset therefrom is second arm 35 attached by second connector 36. FIG. 8 depicts a rear view of the alternate embodiment demonstrated in FIG. 7.

In FIGS. 9, 10, 11 and 12 the amount of horizontal offset of second arm 35 from first arm 33 is shown. This offset allows for a better display of all articles thereon, and allows them to freely hang as hereinbefore mentioned regarding display hanger 10 in FIG. 2.

Display hanger 30 could likewise be molded of suitable standard polymeric materials using conventional molding techniques although metal, wood or other materials may be utilized. Also, while only two arms are shown for display hanger 30, additional arms could be provided, each offset in the same manner as shown with arm 35 by connector 36.

The illustrations and examples provided herein are for explanatory purposes and are not intended to limit the scope of the appended claims.

We claim:

1. A display hanger comprising a neck, a first arm pair, a second arm pair, said neck attached to said first arm pair, said first and said second arm pairs each comprising arms extending in opposite directions equal distances from said neck, a connector, said connector attached to said first and said second arm pairs, said second arm pair positioned below said first arm pair and horizontally offset therefrom, said first and second arm pairs being substantially flat.

2. The display hanger of claim 1 further comprising a hook, said hook attached to said neck.

3. The display hanger of claim 1 further comprising a third arm pair, said third arm affixed below said second arm pair and horizontally offset therefrom.

4. The display hanger of claim 1 formed from a polymeric material.

5. A display hanger comprising: a neck, a first arm, said neck connected to said first arm, said neck and said first arm located substantially within a plane, a second arm, a first connector, said first connector joining said first arm to said second arm, said second arm positioned below said first arm and horizontally offset from said plane, a third arm, a second connector, said second connector joining said second arm to said third arm, said third arm positioned below said second arm and horizontally offset from said second arm and said plane, each of said arms being substantially flat for supporting articles displayed thereon whereby said articles do not displace one another.

6. The display hanger of claim 5 formed from a polymeric material.

7. The display hanger of claim 5 further comprising a hook, said hook joined to said neck for suspending said display hanger.

8. The display hanger of claim 5 integrally molded.

9. The display hanger of claim 1 further comprising a pair of upward tips, each of said upward tips positioned at opposite terminal ends of said first arm pair.

10. The display hanger of claim 1 wherein said connector is L-shaped.

11. The display hanger of claim 5 further comprising an upward tip, said upward tip affixed to the terminal end of said first arm.

12. The display hanger of claim 5 wherein said first connector is L-shaped.

13. A display hanger comprising: a neck, a first arm, said first arm joined to said neck substantially within a plane, a second arm, said second arm positioned below said first arm and joined thereto, said second arm horizontally offset from said first arm and said plane, and said second arm parallel to said first arm, said first and said second arms being substantially flat.

14. The display hanger of claim 13 further comprising a third arm, said third arm joined to said second arm, said third arm positioned below said second arm, said third arm horizontally offset from said second arm and said plane, and said third arm parallel to said second arm, said third arm being substantially flat.

* * * * *